US005727738A

United States Patent [19]

Hofmann et al.

[11] Patent Number: 5,727,738

[45] Date of Patent: Mar. 17, 1998

[54] FUEL INJECTION VALVE FOR INTERNAL COMBUSTION ENGINES

[75] Inventors: Karl Hofmann, Remseck; Manfred Mack, Altheim, both of Germany

[73] Assignee: Robert Bosch GmbH, Stuttgart, Germany

[21] Appl. No.: 556,053

[22] Filed: Nov. 9, 1995

[30] Foreign Application Priority Data

Nov. 10, 1994 [DE] Germany ..... 44 40 182.5

[51] Int. Cl.[6] ..... F02M 45/02

[52] U.S. Cl. ..... 239/533.4; 239/533.9

[58] Field of Search ..... 239/533.2–533.6, 239/533.9

[56] References Cited

U.S. PATENT DOCUMENTS

| | | | |
|---|---|---|---|
| 5,205,492 | 4/1993 | Khinchuk | 239/533.9 X |
| 5,244,152 | 9/1993 | Hofmann | 239/533.9 X |
| 5,267,694 | 12/1993 | Frank et al. | 239/533.5 |
| 5,413,281 | 5/1995 | Hofmann et al. | 239/533.9 X |

FOREIGN PATENT DOCUMENTS

| | | |
|---|---|---|
| 397289B | 7/1993 | Austria . |
| 568845 | 4/1993 | European Pat. Off. . |
| 2711393 | 9/1978 | Germany . |
| 1110102 | 4/1968 | United Kingdom . |
| 2086473 | 5/1982 | United Kingdom . |

*Primary Examiner*—Lesley D. Morris

*Attorney, Agent, or Firm*—Edwin E. Greigg; Ronald E. Greigg

[57] ABSTRACT

A fuel injection valve for internal combustion engines having a valve element which is axially displaceable in a valve body and a valve retention body, which is configured as a twin-spring retainer and in which are arranged first and second valve springs acting on the valve element in the closing direction. The first valve spring acts continually on the valve element via a pressure pin, whereas the second valve spring acts on the valve element only after a certain opening stroke motion of the valve element, which motion traversed forms a preliminary stroke (h1), and, by this motion, subdivides the opening stroke motion of the valve element into a preliminary stroke against the force of the first valve spring and a residual stroke against the force of the first and second valve springs. In order to be able to undertake the formation of the injection curve described even in the case of high rotational speeds and full load, a damping space bounded by the valve element is provided on the injection valve, which damping space can be shut off during the opening stroke motion of the valve element during the residual stroke of the latter.

10 Claims, 3 Drawing Sheets

FUEL INJECTION VALVE FOR INTERNAL COMBUSTION ENGINES

PRIOR ART

The invention is based on a fuel injection valve, for internal combustion engines. In a fuel injection valve of this type known from EP 0 282 480, a piston-shaped valve element is axially guided in a hole in a valve body and has, on one of its ends, a conical sealing surface by means of which it interacts with a valve seat formed on the valve body by a reduction in the diameter of the hole. The injection openings into the combustion space of the internal combustion engine to be supplied are provided at this valve seat. On its end facing away from the sealing surface, the valve element is acted on by a pressure pin which is guided in an intermediate disk adjoining the valve body and in a valve retention body axially clamped to them. In the known fuel injection valve, the valve retention body is configured as a twin-spring retainer, for which purpose two valve springs are arranged one behind the other in a chamber formed inside the twin-spring retainer, the valve springs acting via spring plates on the pressure pin and, in turn, on the valve element.

In order to achieve an opening stroke motion of the valve element in two steps with a short dwell period between the two steps, which is favorable for the fuel preparation in the combustion space of the internal combustion engine, only a first valve spring is initially in contact with the pressure pin, which holds the valve element in contact with the valve seat, in the rest condition, i.e. when the injection valve is closed.

A second valve spring only comes into contact with the pressure pin after a certain opening stroke motion (preliminary stroke) of the valve element has been traversed so that the closing force acting against the opening force is increased in a second step (residual stroke) of the opening stroke motion.

The opening stroke motion of the valve element takes place by means of the continuously increasing fuel pressure which acts on an annular shoulder of the valve element, initially overcomes the force of the first spring and raises the valve element from its seat. After the preliminary stroke has been traversed and the force of the second valve spring becomes effective, the fuel pressure is briefly insufficient to displace the valve element further in a continuous manner against the force of the two valve springs so that the valve element remains briefly in its stroke position. After a certain fuel pressure—which can be set above the preload of the second spring—has been reached, the valve element is then displaced further against the force of the two valve springs and traverses its residual stroke until it comes into contact with a stop.

The known fuel injection valve does, however, have the disadvantage that at high rotational speeds and high load (large injection quantities), the fuel pressure acting on the valve element—and, in consequence, the opening stroke speed of the valve element—increases so rapidly that the dwell condition between the preliminary stroke and the residual stroke is passed over so that the opening cross section at the injection openings is completely opened up very rapidly, which has negative effects on the preparation of the fuel injected in the combustion space of the internal combustion engine.

With the known fuel injection valve, therefore, it is impossible to maintain the formation of the injection curve as described above even at high rotational speeds or high load.

Advantages of the invention

The fuel injection valve has, an advantage that even at high rotational speeds and high load (full-load range), a formation of the injection curve is possible in which the preliminary stroke and the residual stroke are clearly defined and can be separated from one another.

This is achieved in an advantageous manner by the provision of a damping space bounded, at least indirectly, by the valve element. This damping space can be shut off in such a way that the pressure built up in it acts against the opening stroke motion of the valve element during the residual stroke of the latter whereas the preliminary stroke remains undamped in the known manner. Because the valve element or the pressure pin forms the moving wall of the damping space directly, the rotational speed or load-dependent stroke speed of the valve element is a direct control parameter for the amount of damping so that the damping force supporting the force of the valve springs increases with increasing stroke speed of the valve element, particularly during the residual stroke, and thus permits the desired formation of the injection curve at high rotational speed and load.

It is particularly advantageous to shut off the damping space after the preliminary stroke of the valve element has been traversed in order, by this means, to ensure the damping effect when the second valve spring begins to be effective.

As an alternative, however, it is also possible—particularly when very small preliminary strokes are provided—to close the damping space by means of a small flow passage, which forms a throttle, immediately at the beginning of the opening stroke motion; the stroke of the valve element until an effective damping pressure is built up in the damping space then corresponds to the small, undamped preliminary stroke of the valve element. The magnitude of this small undamped preliminary stroke can then be set in an advantageous manner by the magnitude of the cross section of the flow passage between the damping space and a relief space or the volume to be compressed in the damping space. Here again, the speed with which the damping pressure builds up depends greatly on the stroke speed of the valve element so that very short undamped preliminary strokes of the valve element can be achieved in the case of high pressures. A further control of the build-up of the damping pressure can be undertaken by providing storage spaces connected to the damping space.

The damping space with a relief space, preferably formed between the valve body and an intermediate disk and preferably being the flow passage connecting the chambers accommodating the valve springs, is formed, in an advantageous manner, on a pressure pin which is guided in the intermediate disk and is non-positively connected to the valve element. The flow passage can be configured as a ground surface or axial groove on the peripheral surface of or as a longitudinal hole within the pressure pin. A control edge, by means of which the flow passage can be shut off by the valve element after the preliminary stroke has been traversed, is provided in each case. The opening of the flow passage into the damping space is advantageously shut off by this opening entering the hole in the intermediate disk.

Further advantages and advantageous embodiments of the subject matter of the invention can be taken from the description, the drawing and the patent claims.

BRIEF DESCRIPTION OF THE DRAWINGS

Three embodiment examples of the fuel injection valve, according to the invention, for internal combustion engines are represented in the drawing and are explained in more detail in the following description.

DESCRIPTION OF THE EMBODIMENT EXAMPLES

Figure 1:
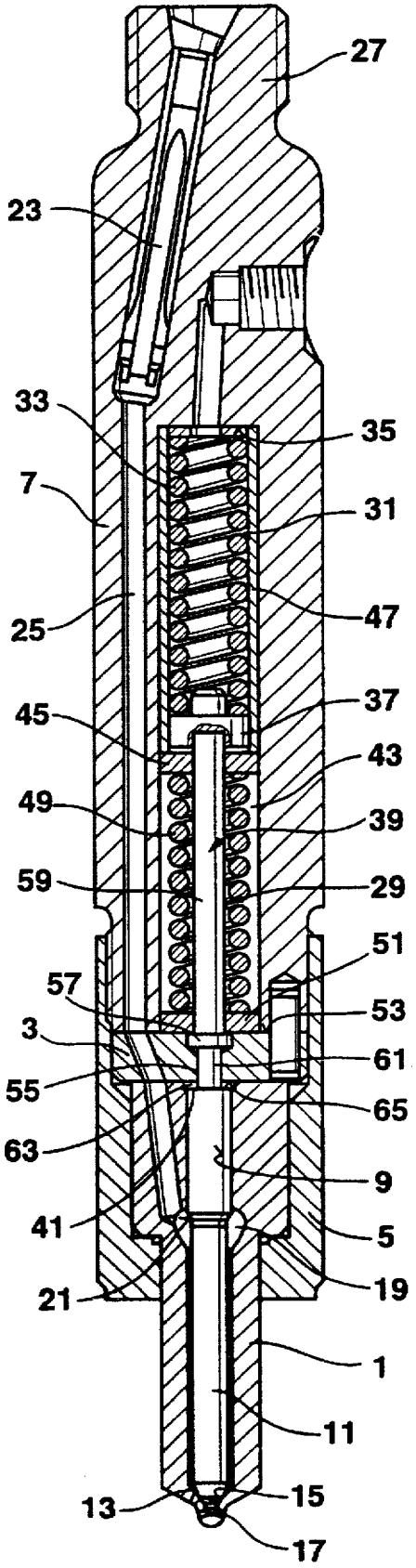
FIG. 1 shows a longitudinal section through the injection valve.

The fuel injection valve, for internal combustion engines, represented in FIG. 1 has a valve body 1 which, together with an intermediate disk 3 in contact with one of its ends, is firmly clamped to a valve retention body 7 by means of a union nut 5. The valve body 1, whose end remote from the intermediate disk 3 protrudes into a combustion space (not shown) of an internal combustion engine, has a guide hole 9 in which a piston-shaped valve element 11 can be axially displaced. At one of its ends, the valve element 11 has a conical sealing surface 13 by means of which it interacts with a valve seat 15 formed by a reduction in the diameter of the guide hole 9. This valve seat 15 is arranged on the combustion-space end region of the valve body 1 and bounds injection openings 17 which are provided at the end region of the guide hole 9 and which adjoin the valve seat 15 downstream in the injection direction. In known manner, the guide hole 9 of the valve element 11 widens at one point into a pressure space 19 in the region of which the valve element 11 has a pressure shoulder 21. This pressure space 19 is connected, via a supply passage 25 containing a filter 23, to a connecting mouthpiece 27 on the valve retention body 7, a fuel supply conduit (not shown) from a high-pressure fuel pump being connected to the connecting mouthpiece 27. At its other end, the pressure space 19 is connected to the valve seating surface 15 and the injection openings 17, in known manner, by means of an annular gap between the stem of the valve element 11 and the wall of the guide hole 9.

A chamber 29 for accommodating two valve springs acting, in the closing direction, on the valve element 11 is provided in the valve retention body 7, which is configured as a twin-spring retainer. In a first spring space 31, a first valve spring 33 is arranged which is supported at a fixed location on the end wall 35 of the end, remote from the intermediate disk 3, of the chamber 29 or of the first spring space 31. At its other end, the valve spring 33 acts continuously on the valve element 11 by means of a spring plate 37 on a pressure pin 39, whose other end is in contact with the end 41, facing away from the sealing surface 13, of the valve element 11. Within the chamber 29, a second spring space 43 adjoins the first spring space 31 in the direction toward the intermediate disk 3. This second spring space 43 is separated from the first spring space 31 by a disk 45. In the direction toward the first spring space 31, this disk 45 is in contact with a sleeve 47 which forms an annular projection which is fixed relative to the housing and encloses the first spring space 31 and, by this means, forms a fixed-location stop of a second valve spring 49, which is supported on it, is located in the second spring space 43 and surrounds the pressure pin 39, which is guided by a hole through the disk 45. At its valve-element end, the second valve spring 49 is supported on a disk-shaped pressure piece 51 whose other end is in contact with an upper end surface 53 of the intermediate disk 3 and by means of which the stem of the pressure pin 39 is displaceably guided.

In the region of its passage through a stepped hole 55 in the intermediate disk 3, the pressure pin 39 has an annular projection 57 which, during the opening stroke motion of the valve element 11, comes into contact with the pressure piece 51, which can be axially displaced into the second spring space 43, when it emerges from the intermediate disk 3 after a certain stroke distance The pressure pin 39 is preferably configured in two parts, a first part 59 leading from the spring plate 37 to the annular projection 57 and a second part 61 being formed by the cylindrical connecting piece, which is guided in the part of the stepped hole with the smaller diameter, between the annular projection 57 and the end 41 of the valve element 11.

In a manner in accordance with the invention, a fuel-filled damping space 63 is also provided on the fuel injection valve. This is bounded by the end surface 41, of the valve element 11, which is larger than the diameter of the second part 61 of the pressure pin 39, and the lower end surface 65, of the intermediate disk 3, facing toward the valve element 11. The configuration of this damping space 63 is dealt with in more detail in the description of FIGS. 2 to 5.

Figure 2:
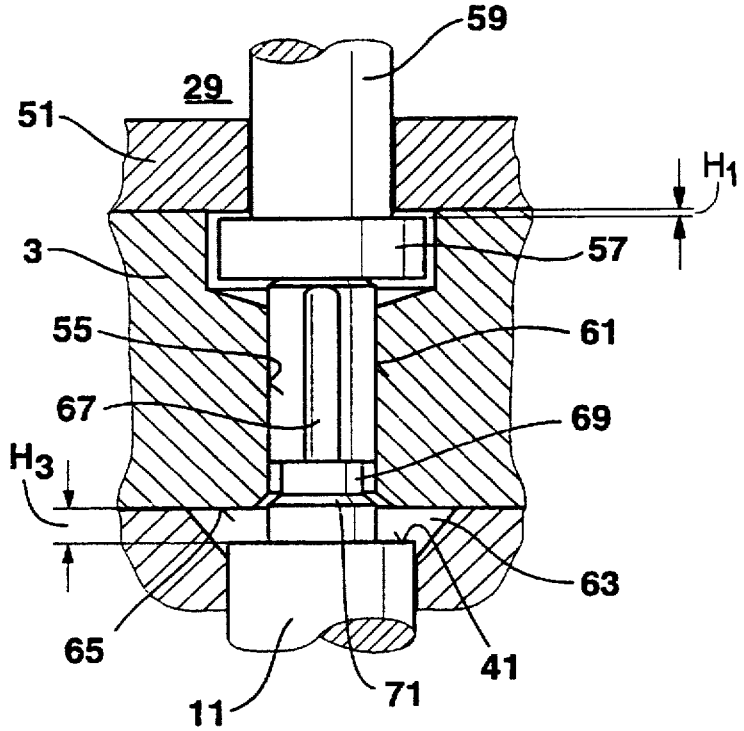
FIG. 2 shows—in an excerpt from FIG. 1—a first embodiment example in which the flow passage of the damping space is formed by an axial groove and annular groove on the pressure pin.

A first embodiment example in which the damping space 63 can be shut off and relieved by means of an axial/annular groove arrangement, which is located on the pressure pin part 61 and forms a flow passage from the damping space 63 to the chamber 29, is represented in FIG. 2.

For this purpose, the pressure pin part 61 has an axial groove 67 on its peripheral surface starting from the end facing toward the annular projection 57. This axial groove opens into an annular groove 69 on the end of the pressure pin part 61 near the valve element, the stem of the pressure pin part 61 being continued in the direction toward the valve element 11. The width of the annular groove 69 protruding into the damping space 63 in the closed position of the valve element 11 is configured in such a way that its edge 71 near the valve element passes over the lower end surface 65 of the intermediate disk 3 after it has traversed a certain opening stroke motion so that the wall of the hole 55 closes the annular groove 69 and the connection between the damping space 63 and the fuel-filled chamber 29 is shut off. This undamped stroke motion, which corresponds to a preliminary stroke, is preferably of the same magnitude as the stroke motion H1 which occurs before the annular projection 57 comes into contact with the pressure piece 51, the second valve spring 49 becoming effective after this stroke motion H1 has been traversed.

In order to avoid functional impairment due to tilting and contacts between the edge 71 and the end surface 65, the edge 71 and the corresponding annular edge at entry of the hole 55 into the end surface 65 of the intermediate disk 3 have a chamfer which ensures reliable introduction of the pressure pin part 61 into the stepped hole 55.

The maximum opening stroke H3 of the valve element 11 is limited, as in all the other embodiment examples, by contact between the end surface 41 of the valve element 11 and the lower end surface 65 of the intermediate disk 3.

Figure 3:
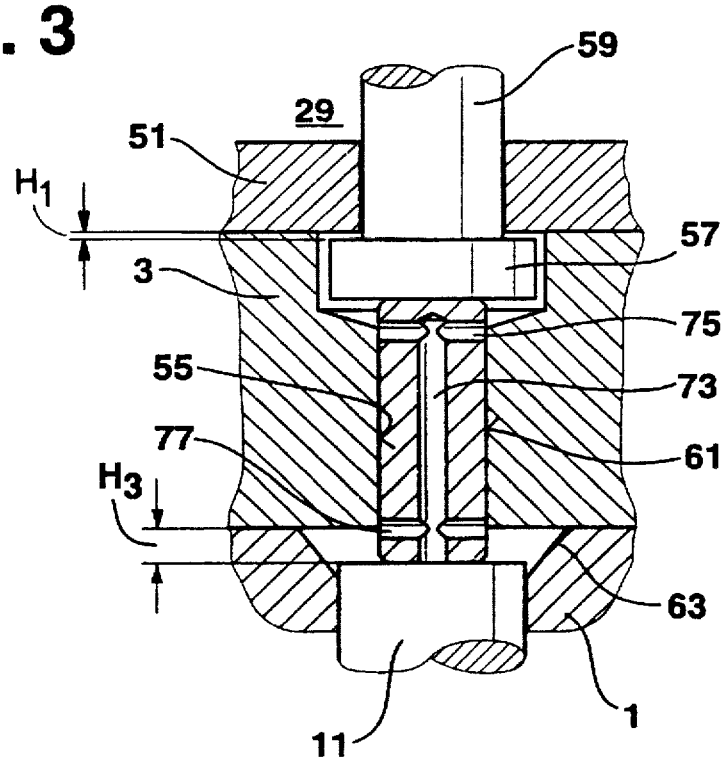
FIG. 3 shows a second embodiment example which is analogous to the representation of FIG. 2 and in which the flow passage of the damping space is designed as a longitudinal hole and transverse hole in the pressure pin.

The second embodiment example shown in FIG. 3 differs from the first embodiment example by the manner in which the flow passage between the damping space 63 and the chamber 29 is configured. In this case, the flow passage is formed by an axial longitudinal hole 73, which is located in the pressure pin part 61 and is intersected by two transverse holes. A first, upper transverse hole 75 is arranged in such a way that it opens continuously into a part of the stepped hole 55, which part accommodates the annular projection 57 and is connected to the chamber 29 by a clearance between the pressure pin 39 and the pressure piece 51. A second, lower transverse hole 77 is arranged in such a way that it opens into the damping space 63 in the closed position of the valve element 11 and is closed by the wall of the hole 55 after the preliminary stroke H1 of the valve element 11 has been traversed, i.e. after the annular projection 57 comes into contact with the pressure piece 51; the annular edge on the inlet opening of the hole 55 and the lower edge of the lower transverse hole 77 form interacting control edges. The instant when the damping space 63 is shut off can be set to the particular requirements by means of the axial position of the lower transverse hole 77.

Figure 4:
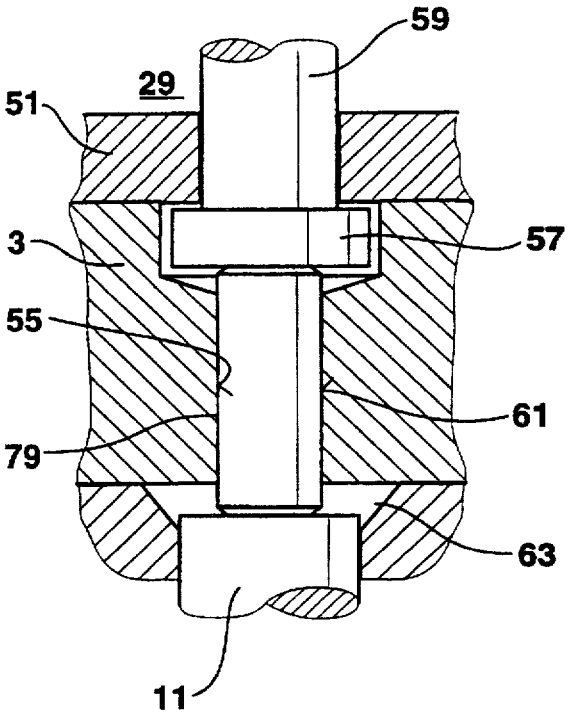
FIG. 4 shows a third embodiment example in which the flow passage of the damping space is configured as an annular gap between the pressure pin and the wall of the hole in the intermediate disk and FIG. 5 shows a further design of the third embodiment example with an additional storage space connected to the damping space.

In the third embodiment example represented in FIG. 4, the flow passage between the damping space 63 and the chamber 29 is formed by means of an annular gap 79 between the wall of the hole 55 in the intermediate disk 3 and the outer surface of the pressure pin part 61. The throttling effect at the annular gap 79, which throttling effect leads to the flow passage being shut off once a certain pressure has been reached in the damping space 63, can be set as a function of the stroke speed of the valve element 11 by means of the dimension of the annular gap 79. The time to build up this pressure corresponds to the undamped preliminary stroke of the valve element 11.

Figure 5:
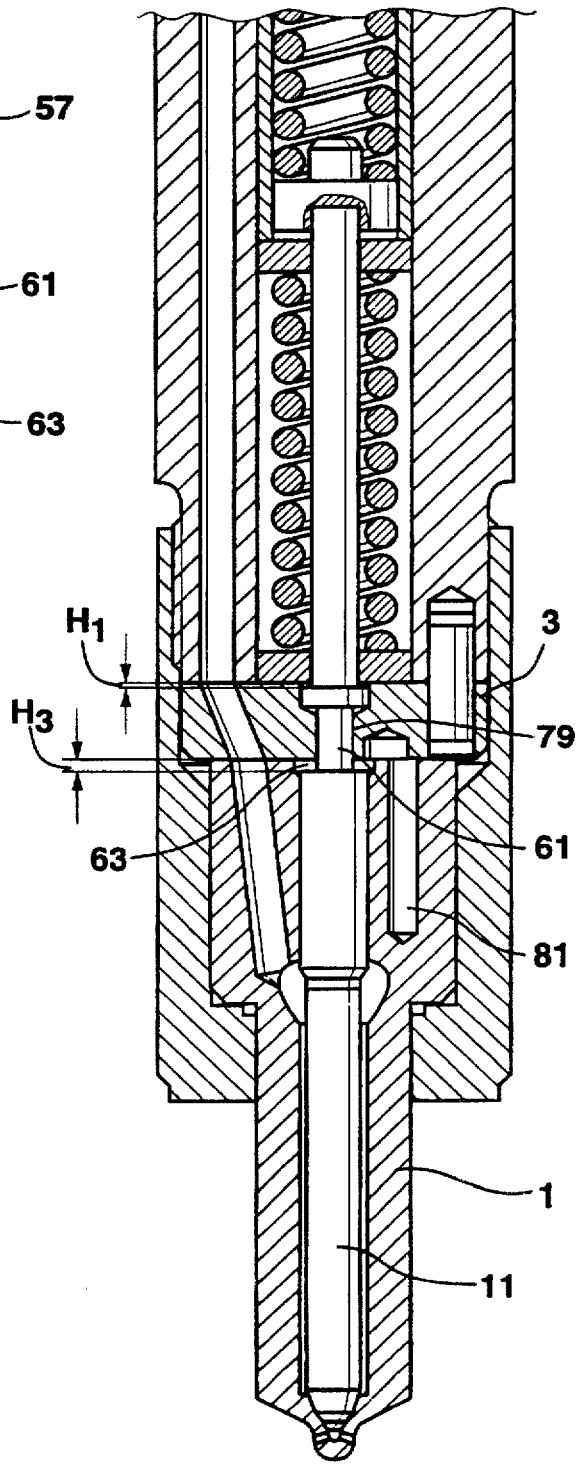

The coming into effect of the throttle at the annular gap 79 can be set by the design of the damping space 63, which can be increased by an additional storage space 81, as represented in FIG. 5. This storage space 81 can preferably be designed as a blind hole which can be inserted in the valve body 1 and/or the intermediate disk 3.

The fuel injection valve according to the invention operates in the following manner.

In the rest condition, the sealing surface 13 of the valve element 11 is held in contact with the valve seat 15 by the force of the first valve spring 33 so that the injection valve is closed.

When the high-pressure fuel delivery begins at the fuel pump, the pressure space 19 is subjected to high-pressure fuel via the supply passage 25 and this leads to an increase in pressure in the pressure space 19. This increase in pressure acts on the pressure shoulder 21 of the valve element 11 and raises the latter, in known manner, from the valve seat 15 against the force of the first valve spring 33. A limited preliminary injection quantity is then injected into the combustion space of the internal combustion engine. This preliminary stroke H1 of the valve element 11, which forms a first stage of the injection, is ended when the annular projection 57 on the pressure pin 39 comes into contact with the pressure piece 51. The valve element 11 remains in this position because the continually increasing fuel pressure in the pressure space 19 must first reach a value which exceeds the force of the two valve springs 33 and 49. Preferably at the same time as (or shortly before) contact between the annular projection 57 and the pressure piece 51, the damping space 63 is also shut off so that a pressure builds up in the latter during the further valve element opening stroke. This pressure, together with the force of the two valve springs 33 and 49, acts against the opening stroke motion of the valve element 11. Particularly in the case of the third embodiment example, this build-up of pressure depends on the stroke speed of the valve element 11 and increases in proportion to the stroke speeds of the valve element so that the maximum damping force is attained at high rotational speed and load on the internal combustion engine.

After a damped residual stroke forming a second step of the injection procedure has been traversed, the end surface 41 of the valve element 11 reaches the intermediate disk 3; the distance between the end surface 41 of the valve element 11 and the lower end 65 of the intermediate disk 3 fixes the maximum opening stroke H3. The valve element 11 remains in this position until the end of the injection procedure, which is ended by the lowering of the pressure in the pressure space 19. As a result of this, the valve element is again brought into contact with the valve seat 15 by the valve springs 33 and 49.

The pressure in the damping space 63 is relieved into the chamber 29 via the respective flow passage on the pressure pin part 61 and excess fuel can be removed from this chamber 29 via a return conduit.

By means of the fuel injection valve in accordance with the invention, therefore, it is possible to undertake a formation of the injection curve in two steps even at high rotational speeds and high load. The design dimensions of the original injection valve can be retained by the provision, in a simple design, of a damping space 63 at the intermediate disk 3 and of a flow passage, which can be shut off, on the pressure pin 39.

The foregoing relates to preferred exemplary embodiments of the invention, it being understood that other variants and embodiments thereof are possible within the spirit and scope of the invention, the latter being defined by the appended claims.

We claim:

1. A fuel injection valve for internal combustion engines having an axially displaceable valve element (11) which is guided in a guide hole (9) of a valve body (1), said valve body (1) is clamped via an intermediate disk (3) against a valve retention body (7) in which is provided a chamber (29) for accommodating first and second valve springs that act on the valve element (11) in the closing direction, said first valve spring (33) acts continually on the valve element (11) via a pressure pin (39), whereas said second valve spring (49) acts on the valve element (11) only after a certain opening stroke motion of the valve element (11), which motion traversed forms a preliminary stroke (h1), and, by this means, subdivides the opening stroke motion of the valve element (11) into a preliminary stroke against the force of the first valve spring (33) and a residual stroke against the force of the first and second valve springs (33, 49), wherein the valve element (11) bounds, at least indirectly, a fuel-filled damping space (63) which is shut off during the opening stroke motion of the valve element (11) in such a way that the pressure built up in the damping space acts against the opening stroke of the latter.

2. The fuel injection valve as claimed in claim 1, wherein the damping space (63) is shut off at the end of the preliminary stroke of the valve element (11).

3. The fuel injection valve as claimed in claim 1, wherein the valve element (11) has, at one of its ends, a sealing surface (13) that interacts with a valve seat (15) on the valve body (1) and wherein the damping space (63) is formed between the end (65), facing toward the valve body (1), of the intermediate disk (3) and the end surface (41) on the end, facing away from the sealing surface (13), of the valve element (11), a part (61), of the pressure pin (39), which is reduced in diameter relative to the end surface (41) of the valve element (11), being also in contact with this end facing away from the sealing surface (13), of the valve element (11).

4. The fuel injection valve as claimed in claim 3, wherein the pressure pin (39) has a flow passage in the part (61) of a hole (55) located in the intermediate disk (3) and guiding the pressure pin (39), which flow passage connects the damping space (63) to the fuel-filled chamber (29) located in the valve retention body (7) and accommodating the valve spring (33, 49), which flow passage can be shut off after a certain opening stroke distance.

5. The fuel injection valve as claimed in claim 4, wherein the flow passage on the pressure pin part (61) is formed by an axial groove (67) in its peripheral surface, which axial groove opens, at its end facing toward the damping space (63), into an annular groove (69) on the pressure pin part (61), which annular groove (69) enters fully into the hole (55) of the intermediate disk (3) and is closed by this hole (55) after the preliminary stroke motion of the valve element (11) has been traversed.

6. The fuel injection valve as claimed in claim 4, wherein the flow passage on the pressure pin part (61) is formed by a longitudinal hole (73) and two transverse holes intersecting the latter, an upper transverse hole (75) opening continuously into a space connected to the chamber (29) and a lower transverse hole (77) opening into the damping space (63) until the preliminary stroke of the valve element (11) has been traversed and being closed by the wall of the hole (55) in the intermediate disk (3) during the residual stroke of the valve element (11).

7. The fuel injection valve as claimed in claim 6, wherein the annular edge formed on the damping-space end inlet opening of the hole (55) in the intermediate disk (3) forms a first control edge which interacts with a second control edge formed on the edge, facing toward the valve element (11), of the lower transverse hole (77) in the pressure pin part (61), it being possible to set the instant when the damping space (63) is shut off by means of the distance between the control edges when the valve element (11) is in contact with the valve seat (15).

8. The fuel injection valve as claimed in claim 4, wherein the flow passage is formed by means of an annular gap (79) between the peripheral surface of the pressure pin part (61) and the wall of the hole (55) in the intermediate disk (3), which annular gap (79) is designed in such a way that once a certain increase in pressure in the damping space (63) has been reached, the throttling effect in the annular gap (79) prevents fuel from flowing out of the damping space (63).

9. The fuel injection valve as claimed in claim 8, wherein the damping space (63) is connected to a storage space (81) which is preferably formed by a blind hole in the valve body (1) and/or the intermediate disk (3).

10. The fuel injection valve as claimed in claim 4, wherein the pressure pin (39) is designed in two parts, the pin part (61) which has the flow passage and is guided in the hole (55) of the intermediate disk (3) forming a first pressure pin and the pin part (59) which has the spring plates (37, 51) of the valve springs (33, 49) and protrudes into the chamber (29) of the valve retention body (7) forming a second pressure pin which is held in contact with the second pressure pin by the preloading force of the first valve spring (33).

* * * * *